US007722387B2

(12) United States Patent
Yamaji et al.

(10) Patent No.: US 7,722,387 B2
(45) Date of Patent: May 25, 2010

(54) BOARD CONNECTOR, MATING CONNECTOR, AND ELECTRONIC DEVICE INCLUDING THE SAME

(75) Inventors: Takahiro Yamaji, Tokyo (JP); Keizo Kai, Tokyo (JP); Shingo Nanao, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/217,009

(22) Filed: Jul. 1, 2008

(65) Prior Publication Data

US 2009/0029598 A1 Jan. 29, 2009

(30) Foreign Application Priority Data

Jul. 26, 2007 (JP) ..... 2007-195087

(51) Int. Cl.
*H01R 12/24* (2006.01)

(52) U.S. Cl. ..... 439/497; 439/660

(58) Field of Classification Search ..... 439/495–497, 439/108, 607, 610, 660
See application file for complete search history.

(56) References Cited

U.S. PATENT DOCUMENTS

| | | | | |
|---|---|---|---|---|
| 5,470,259 | A | 11/1995 | Kaufman et al. | |
| 7,134,907 | B2 * | 11/2006 | Watanabe et al. | 439/495 |
| 7,207,842 | B1 | 4/2007 | Kenjo | |
| 7,220,146 | B2 | 5/2007 | Miyazaki | |
| 7,377,803 | B2 | 5/2008 | Matsuoka | |
| 2006/0172589 | A1 | 8/2006 | Watanabe et al. | |

FOREIGN PATENT DOCUMENTS

| | | |
|---|---|---|
| JP | 8-255656 | 10/1996 |
| JP | 2003-007378 | 1/2003 |
| JP | 2005-129255 | 5/2005 |
| JP | 2005-302417 | 10/2005 |
| JP | 2005-339985 | 12/2005 |
| JP | 3-119722 | 2/2006 |
| JP | 3118719 | 2/2006 |

(Continued)

OTHER PUBLICATIONS

European Search Report dated Sep. 22, 2008.

(Continued)

*Primary Examiner*—Khiem Nguyen
(74) *Attorney, Agent, or Firm*—Collard & Roe, P.C.

(57) ABSTRACT

A board connector has a plurality of contacts, an insulator holding the plurality of contacts, and a shell covering at least a part of the insulator. Each contact has an SMT terminal to be connected to a wiring pattern on a board. The insulator has a first insulator portion extending in an X-direction and two second insulator portions each extending in a Y-direction perpendicular to the X-direction. The first insulator portion has a bottom surface and first ends in the X-direction. Each second insulator portion has second ends. Each second insulator portion extends from the first ends to the second ends, respectively. The second ends are positioned on an imaginary straight line. The first insulator portion, the second insulator portions, and the imaginary straight line define a predetermined area. The SMT terminals are held by the insulator so that the SMT terminals are positioned within the predetermined area.

12 Claims, 7 Drawing Sheets

FOREIGN PATENT DOCUMENTS

| | | |
|---|---|---|
| JP | 2006-147473 | 6/2006 |
| JP | 2006-244732 | 9/2006 |
| JP | 2006-344524 | 12/2006 |
| JP | 2007-317554 | 12/2007 |
| WO | WO 2005/043687 | 5/2005 |
| WO | WO 2007/110699 | 10/2007 |
| WO | WO 2007/140075 | 12/2007 |

OTHER PUBLICATIONS

Provisional opinion of the Examiner, Sep. 22, 2008.

Japanese Office Action dated May 7, 2009 with English translation of same.

Japanese Office Action dated Aug. 20, 2009 with English translation of same.

* cited by examiner

BOARD CONNECTOR, MATING CONNECTOR, AND ELECTRONIC DEVICE INCLUDING THE SAME

CROSS REFERENCE TO RELATED APPLICATIONS

Applicants claim priority under 35 U.S.C. §119 of Japanese Application No. 2007-195087 filed Jul. 26, 2007.

BACKGROUND OF THE INVENTION

This invention relates to a board connector having an SMT (Surface Mount Technology) terminal, a mating connector to be connected with the board connector, and an electronic device including the board connector and the mating connector.

There have been proposed various kinds of connector assemblies for connecting a plurality of cables to a circuit-board in an electronic device such as a notebook computer or a cellular phone. JP-U 3118719 and JP-A 2005-302417, each of which is incorporated herein by reference in its entirety, disclose the conventional type of the connector assembly and discuss the measures against the noise. However, JP-U 3118719 and JP-A 2005-302417 do not present the sufficient countermeasures.

SUMMARY OF INVENTION

It is an object of the present invention to provide a connector assembly having a structure capable of reducing a noise.

In accordance with one aspect of the present invention, there is provided a board connector comprising a plurality of contacts each having an SMT (Surface Mount Technology) terminal to be connected to a wiring pattern on a board, an insulator; and a shell covering, at least in part, the insulator. The insulator has a first insulator portion extending in a first direction and two second insulator portions each extending in a second direction perpendicular to the first direction. The first insulator portion has first ends in the first direction. The first insulator portion has a bottom surface. Each of the second insulator portions has a second end. The second insulator portions extend from the first ends to the second ends, respectively. The second ends are positioned on an imaginary straight line. The first insulator portion, the second insulator portions and the imaginary straight line define a predetermined area. The first insulator portion holds the plurality of contacts so that the SMT terminal is positioned in the predetermined area or on the bottom surface of the first insulator portion as seen from below the board connector.

In accordance with another aspect of the present invention, there is provided a mating connector fittable with the board connector. The mating connector comprises a mating shell. When the board connector and the mating connector are fitted with each other, the shell of the board connector and the mating shell are positioned over the SMT terminals to electrically shield the SMT terminals.

The board connector and the mating connector occupying a specific area when the board connector and the mating connector are fitted with each other. Assuming the specific area is equally divided into three regions in the second direction, the SMT terminals are positioned in a middle one of the three regions.

In accordance with another aspect of the present invention, there is provided an electronic apparatus comprising the board connector and the mating connector, wherein the board connector is fitted with the mating connector.

An appreciation of the objectives of the present invention and a more complete understanding of its structure may be had by studying the following description of the preferred embodiment and by referring to the accompanying drawings.

Figure 1:
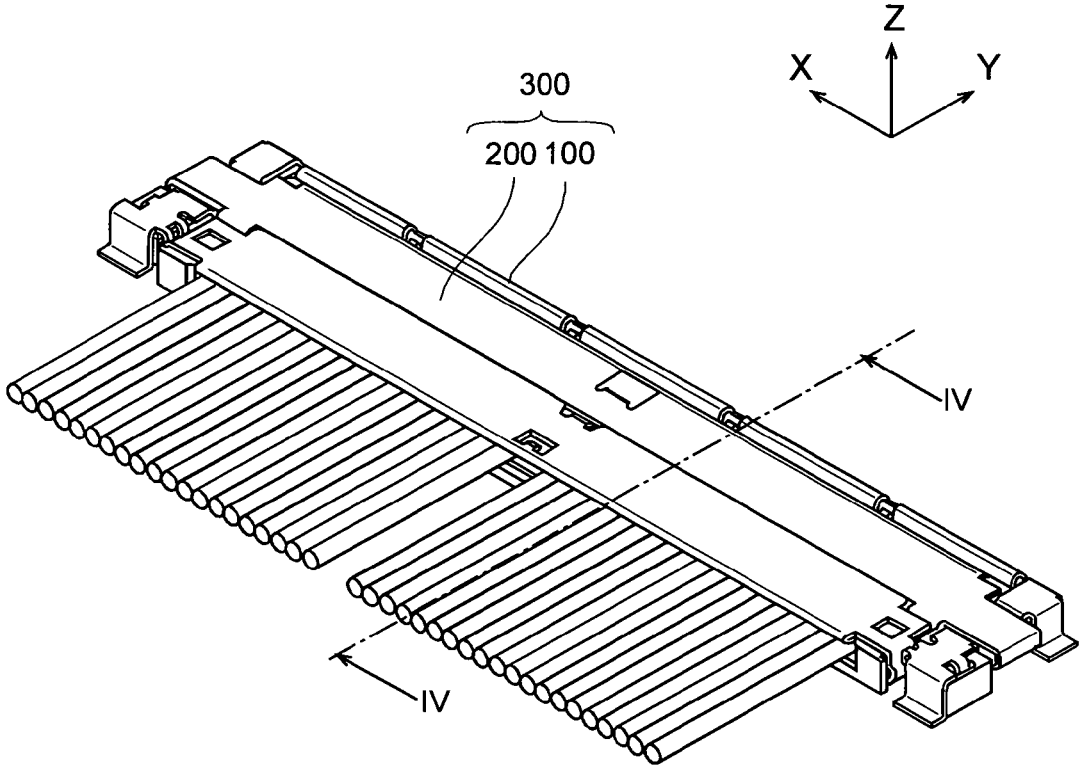
FIG. 1 is a perspective view of a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF THE PREFERRED EMBODIMENT

Figure 2:
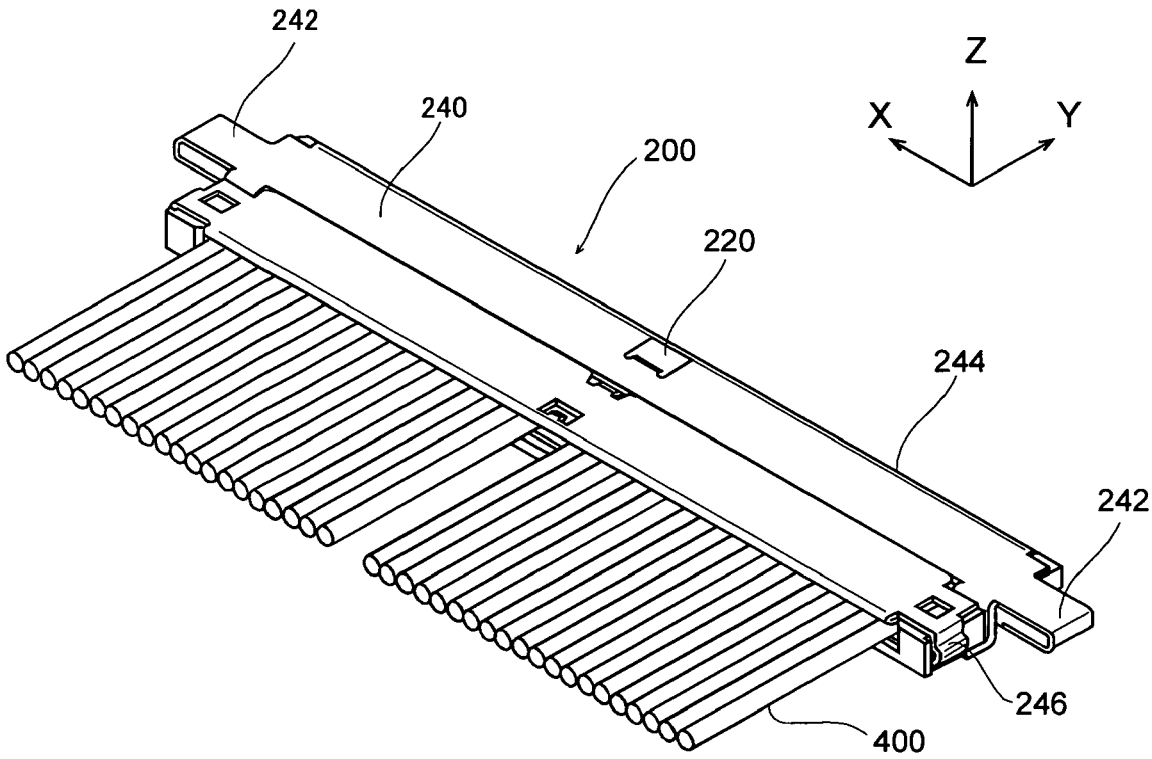
FIG. 2 is a perspective view showing a mating connector constituting the connector assembly of FIG. 1.
Figure 3:
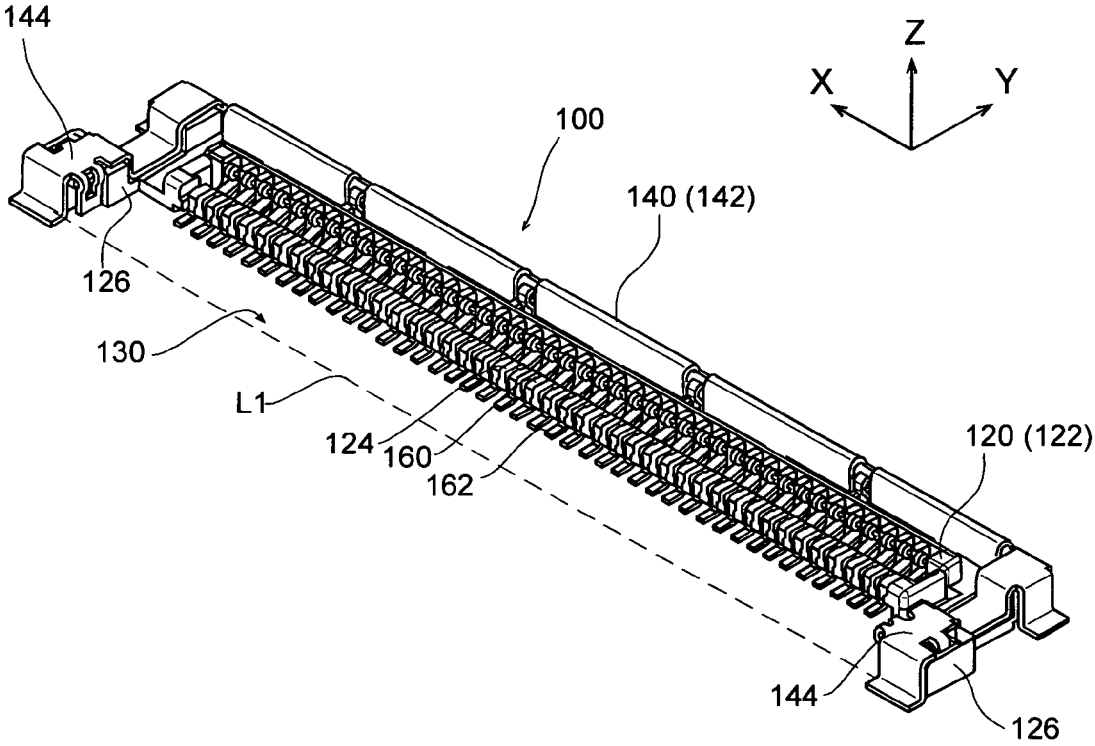
FIG. 3 is a perspective view of a board connector constituting the connector assembly of FIG. 1.

With reference to FIGS. 1 to 3, a connector assembly 300 according to an embodiment of the present invention comprises a board connector 100 to be mounted on a board and a mating connector 200 connected to a plurality of cables 400. The board connector 100 is fittable with the mating connector 200. The connector assembly 300 is generally used in electronic devices such as a cellular phone.

Figure 4:
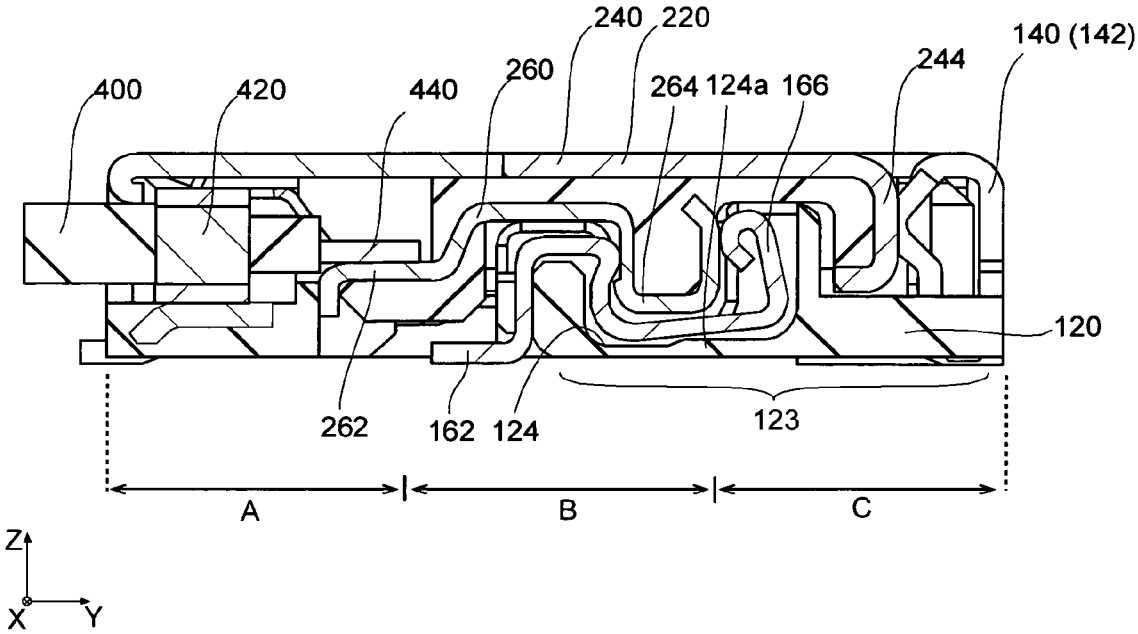
FIG. 4 is a cross sectional view showing the connector assembly taken along lines IV-IV in FIG. 1.

With reference to FIGS. 2 and 4, the mating connector 200 according to this embodiment has a mating insulator 220, a mating shell 240, and a plurality of mating contacts 260.

The mating insulator 220 extends in an X-direction and holds the plurality of mating contacts 260.

The mating shell 240 extends in the X-direction and covers the mating insulator 220. The mating shell 240 is connected to the shield portions 420. The mating shell 240 has two end portions 242, a front end portion 244, and two connection portions 246. Each of the end portions 242 protrudes from the mating shell 240 in the X-direction. The front end portion 244 is formed on a front end of the mating shell 240 in a Y-direction.

Each mating contact 260 has a first connect portion 262 to be connected to a signal conductor 440 of the cable 400 and a second connect portion 264 for establishing a connection with the board connector 100.

With reference to FIGS. 3 and 4, the board connector 100 comprises an insulator 120, a shell 140 covering a part of the insulator 120, and a plurality of contacts 160 held by the insulator 120.

Figure 7:
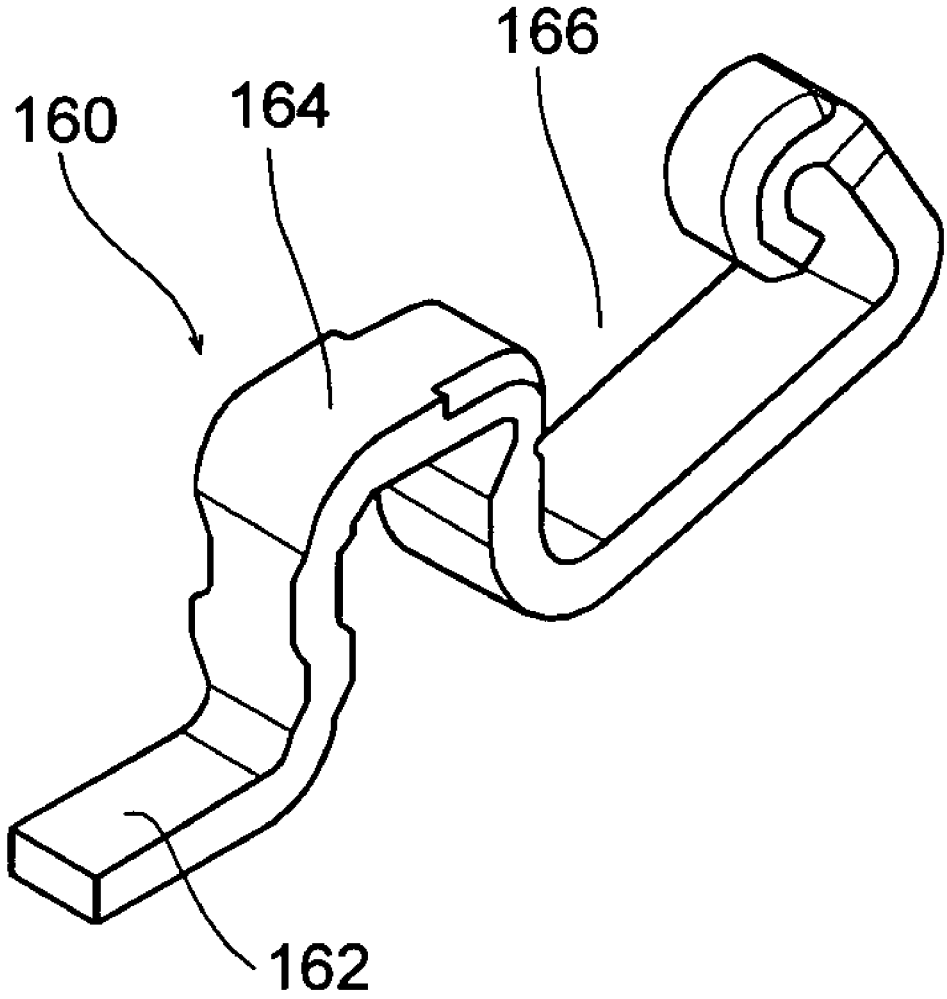
FIG. 7 shows a contact included in the board connector of FIG. 3.

With reference to FIGS. 3, 4, and 7, each contact 160 has an SMT (Surface Mount Technology) terminal 162, a contact portion 166, and a coupling portion 164. The SMT terminals 162 are connected to a wiring pattern on the board. Each contact portion 166 is connected with the first connect portion 264 of the mating contact 260. The SMT terminal 162 and the connection portion 166 are coupled by the coupling portion 164.

Figure 5:
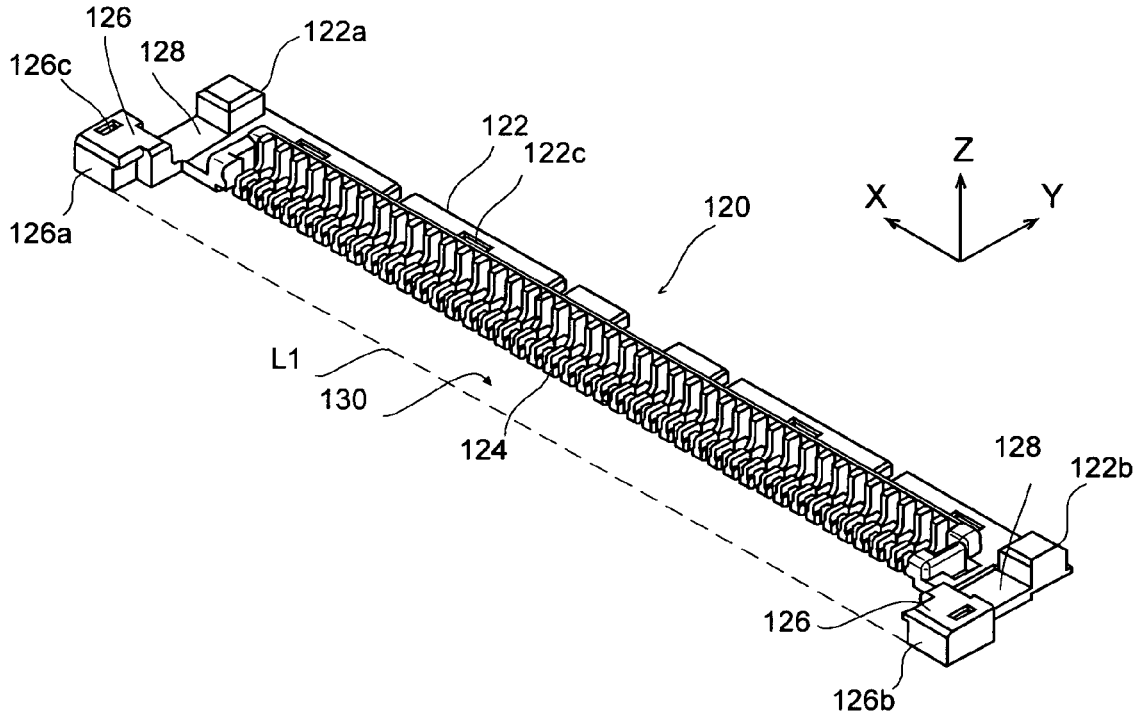
FIG. 5 is a perspective view of an insulator included in the board connector of FIG. 3.

With reference to FIGS. 3 to 5, the insulator 120 has a first insulator portion 122 extending in the X-direction and two second insulator portions 126 each extending in the Y-direction. The first insulator portion 122 has a bottom surface 123 and first ends 122*a* and 122*b* in the X-direction. Each second insulator portion 126 has a second end 126*a*, 126*b*. The second insulator portions 126 extend from the first ends 122*a* and 122*b* to the second ends 126*a* and 126*b*, respectively. The second ends 126*a* and 126*b* are positioned on an imaginary straight line L1. The first insulator portion 122, the second insulator portions 126, and the imaginary straight line L1 define a predetermined area 130 as shown in FIG. 5.

The first insulator portion 122 has a plurality of hold portions 124 each holding the contact 160. The hold portion 124 is provided with a bottom portion 124*a* which has a certain thickness. With this structure, when seen from below the board connector 100, the bottom portion 124*a* hides the contacts 160 except for the SMT terminals 162. This structure enables more effective use of the surface of the board in a way by, for example, forming the wiring patterns on the board at the position directly under the bottom surface 123.

More specifically, according to the present embodiment, each hold portion 124 holds the contact 160 so that the SMT terminal 162 is positioned within the predetermined area 130. The SMT terminals 162 may be positioned under the first insulator portion 122.

As is most clearly shown in FIG. 5, the first insulator portion 122 and the second insulator portions 126 are provided with recesses 122*c* and recesses 126*c*, respectively. In addition, each second insulator portion 126 is provided with a depression 128.

Figure 6:
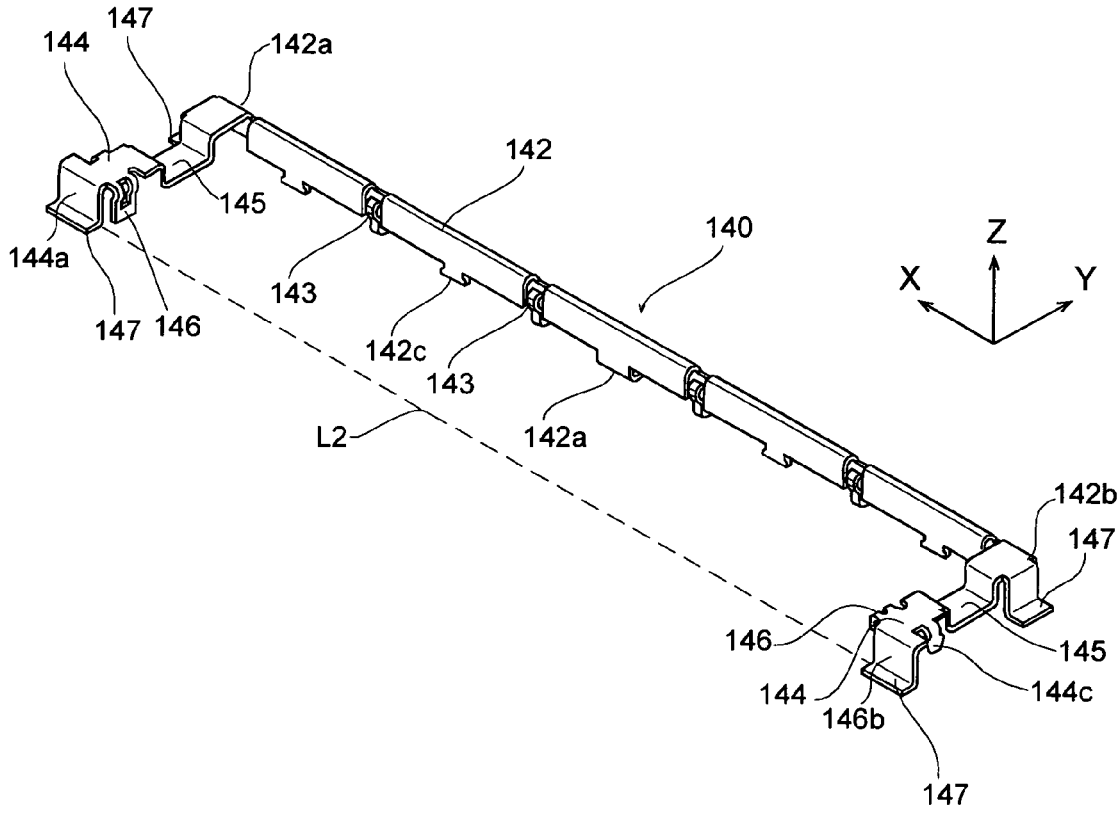
FIG. 6 is a perspective view of a shell included in the board connector of FIG. 3.

With reference to FIGS. 3 and 6, the shell 140 has a first shell portion 142 covering a part of the first insulator portion 122 and second shell portions 144 covering the second insulator portions 126. The first shell portion 142 and the second shell portions 144 are formed integrally with each other.

With reference to FIG. 6, the first shell portion 142 has first ends 142*a* and 142*b* in the X-direction. Each second shell portion 144 has a second end 144*a*, 144*b*. The second shell portions 144 extend from the first ends 142*a* and 142*b* to the second ends 144*a* and 144*b*, respectively. The second ends 144*a* and 144*b* are positioned on an imaginary straight line L2.

The first shell portion 142 has a plurality of projections 142*c* projecting downward in a Z-direction. Similarly, each of the second shell portions 144 has a second projection 144*c* projecting downward in the Z-direction. The first projections 142*c* are pressly-fitted into the recess 122*c*, respectively. The second projections 144*c* are pressly-fitted into the recess 126*c*, respectively. Thus, the shell 140 is fixed to the insulator 120 as shown in FIG. 3. In this state, the SMT terminals 162 are positioned within the predetermined area 130 when seen from above in the Z-direction.

Furthermore, the first shell portion 142 has first spring contact portions 143. Each second shell portion 144 has a second spring contact portion 146. With reference to FIG. 2 together with FIG. 6, the first spring contact portions 143 and the second spring contact portions 146 are connected to the front end portion 244 and the connection portions 246 of the mating shell 240, respectively.

With reference to FIGS. 5 and 6, each of the second shell portions 144 has a cover 145 covering the depression 128 and a hold-down portion 147 for fixing the board connector 100 to the board. A pair of the depression 128 and the cover 145 constitutes a receiver portion which receives the end portion 242 of the mating connector 200 in the Z-direction.

With reference to FIG. 4, the shell 140 of the board connector 100 and the mating shell 240 are positioned over the SMT terminals 162 to electrically shield the SMT terminals 162 when the board connector 100 and the mating connector 200 are fitted with each other. The board connector 100 and the mating connector 200 occupy a specific area when the board connector 100 and the mating connector 200 are fitted with each other. On the assumption that the specific area is equally divided into three regions A, B and C in the Y-direction, the SMT terminals 162 are positioned in a middle region B of the three regions. With this structure, the connector assembly 300 is highly resistive against the noise.

Moreover, the mating connector 200 is configured to hold a plurality of cables 400 which extend in a predetermined direction in a plane perpendicular to the X-direction. The SMT terminal 162 extends in the predetermined direction when the mating connector 200 holding the cables 400 is fitted with the board connector 100. Each of the mating contacts 260 has the first connect portion 264 to be connected to the contact 160 and the second connect portion 262 to be connected to the cable 400. Each of the SMT terminals 162 are positioned between the first and the second connect portions 262, 264 in the Y-direction when the mating connector 200 holding the cables 400 is fitted with the board connector 100.

The present application is based on a Japanese patent application of JP2007-195087 filed before the Japan Patent Office on Jul. 26, 2007, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A board connector comprising:

a plurality of contacts each having an SMT (Surface Mount Technology) terminal to be connected to a wiring pattern on a board;

an insulator having a first insulator portion extending in a first direction and two second insulator portions each extending in a second direction perpendicular to the first direction, the first insulator portion having first ends in the first direction, the first insulator portion having a bottom surface, each of the second insulator portions having a second end, the second insulator portions extending from the first ends to the second ends, respectively, the second ends being positioned on an imaginary straight line, the first insulator portion, the second insulator portions and the imaginary straight line defining a predetermined area as seen from below the board connector, the first insulator portion holding the plurality of contacts so that the SMT terminal of each contact in the board connector for connection to the wiring pattern on the board is positioned only in the predetermined area and no portion of the SMT terminal is positioned outside the predetermined area; and a shell covering, at least in part, the insulator.

2. The board connector according to claim 1, wherein:

the shell has a first shell portion and two second shell portions, the first shell portion and the second shell portions being formed integrally with each other;

the first shell portion covers, at least in part, the first insulator portion; and the second shell portions cover the second insulator portions, respectively.

3. The board connector according to claim 2, wherein the second insulator portions and the second shell portions constitute receiver portions each of which receives a mating connector in part in a third direction perpendicular to the first and the second directions.

4. The board connector according to claim 2, further comprising a mating connector comprising a mating shell, wherein at least one of the second shell portions has a connection portion to be connected to the mating shell.

5. The board connector according to claim 2, wherein each of the second shell portions is formed with a hold-down portion which fixes the board connector to the board.

6. The board connector according to claim 1, wherein the first insulator portion holds the plurality of contacts so that the first insulator portion hides the contacts except the SMT terminals as seen from below the board connector.

7. A mating connector fittable with the board connector according to claim 1, comprising a mating shell, wherein, when the board connector and the mating connector are fitted with each other, the shell of the board connector and the mating shell are positioned over the SMT terminals to electrically shield the SMT terminals.

8. The mating connector according to claim 7, the board connector and the mating connector occupying a specific area when the board connector and the mating connector are fitted with each other, wherein, assuming the specific area is equally divided into three regions in the second direction, the SMT terminals are positioned only in a middle one of the three regions.

9. The mating connector according to claim 7, wherein:

the mating connector is configured to hold a plurality of cables;

the cables extend in a predetermined direction in a plane perpendicular to the first direction; and the SMT terminal extends in the predetermined direction when the mating connector holding the cables is fitted with the board connector.

10. The mating connector according to claim 9, further comprising a plurality of mating contacts to be connected to the cables, respectively, wherein:

each of the mating contacts has a first connect portion to be connected to the contact and a second connect portion to be connected to the cable; and each of the SMT terminals are positioned between the first and the second connect portions in the second direction when the mating connector holding the cables is fitted with the board connector.

11. An electronic apparatus comprising the board connector according to claim 1 and the mating connector according to claim 7, wherein the board connector is fitted with the mating connector.

12. The board connector according to claim 1, wherein the SMT terminal of each contact in the board connector for connection to the wiring pattern on the board is positioned only on the bottom surface of the first insulator portion as seen from below the board connector.

* * * * *